United States Patent [19]

Schuessler

[11] 4,272,853

[45] Jun. 16, 1981

[54] COLD WEATHER HOOD FOR SAFETY HAT

[76] Inventor: Walter E. Schuessler, 800 Redbud La., Wilmette, Ill. 60091

[21] Appl. No.: 108,518

[22] Filed: Dec. 31, 1979

[51] Int. Cl.[3] ..... A42B 1/04; A42B 3/00

[52] U.S. Cl. ..... 2/424; 2/205

[58] Field of Search ..... 2/202, 203, 205, 206, 2/9, 422, 424, 4, 10, 173, 187, 5

[56] References Cited

U.S. PATENT DOCUMENTS

| | | | |
|---|---|---|---|
| 3,100,896 | 8/1963 | Khanbegian | 2/205 X |
| 3,169,252 | 2/1965 | Goldstein | 2/203 |
| 3,271,781 | 9/1966 | Sontag et al. | 2/202 |
| 3,594,814 | 7/1971 | Schuessler | 2/205 X |

FOREIGN PATENT DOCUMENTS

| | | | |
|---|---|---|---|
| 15232 | of 1909 | United Kingdom | 2/187 |

*Primary Examiner*—Peter P. Nerbun

*Attorney, Agent, or Firm*—Tilton, Fallon, Lungmus

[57] ABSTRACT

A knitted hood for use with hard hats to provide cold weather protection for a wearer. The hood is tubular, including an upper portion adapted to be stretched over a hard hat and lower face mask portion capable of being extended over a wearer's face and neck. The face mask portion has at least one elastic-bordered face opening and is also provided with at least one laterally-elongated slit above the level of the face opening(s) for receiving a portion of the brim of a hard hat to anchor the hood against unintentional detachment from the hat.

24 Claims, 7 Drawing Figures

COLD WEATHER HOOD FOR SAFETY HAT

BACKGROUND AND SUMMARY

Protective liners for hard hats have long been known in the art and are disclosed, by way of examples, in U.S. Pat. Nos. 3,205,508 and 2,339,080. The purpose of such a liner is to provide a cold weather protection for a wearer's head since a conventional hard hat is normally spaced from a wearer's head by means of a harness and, therefore, such a hat provides little if any protection from the cold. A long-existing problem has been to combine a liner with a hard hat in such a way that cold weather protection will be readily available when needed but, when not needed, the liner may be easily removed or shifted into a non-functional position. If such a liner extends into the head space defined by the harness, then removal of that liner in warmer weather will require readjustment of the headband size of the harness, whereas if the liner extends into the space between the harness and the hard hat, detachment of such a liner may first require removal of the harness from the hat. In either case, considerable time-consuming manipulation is required in order to attach or detach such liners.

U.S. Pat. Nos. 3,205,508 and 3,594,814 disclose constructions designed to facilitate retraction of a liner when cold weather protection for the face, neck, and ears is not required. While the provision of a liner which may be readily extended and retracted reduces some of the aforementioned problems, it does not eliminate those problems because the presence of a liner, even when fully retracted, may still be objectionable under warm weather conditions. The inconvenience of periodically detaching and reattaching a liner, commonly accompanied by the steps of disconnecting, adjusting, and remounting a harness, still exists with the use of such retractable liners even though such operations may be performed less frequently.

This invention is therefore concerned with an improved protective face hood for use with hard hats, such hood being readily attachable and detachable from a hard hat whenever removal and replacement are desired. While such removal would commonly occur when improved conditions no longer require cold weather protection for a wearer's face, neck, and ears, the hood might also be removed for cleaning or repair, or replacement by a new hood. Ease of detachability is also important where, for example, a hood has become wet from rain or snow and removal is desired to facilitate drying of the hood, possibly while a replacement hood is being used.

A further object of this invention is to provide an easily removable and attachable hood for hard hats which is readily adaptable for use with hats of different size, style, and configuration. While all conventional hard hats have rigid crown and brim portions which are integrally formed from impact-resistant plastic or, less frequently, from metal, differences do exist in the sizes and shapes of the brims, the contours of the crowns, and the configurations and numbers of stiffening ribs extending across such crowns. The hood of this invention is designed to cooperate with all conventional hard hats regardless of such variations.

One aspect of this invention lies in recognizing that many of the aforementioned problems associated with cold weather hoods or liners for hard hats may be overcome by providing a hood which fits over rather than within such a hat. The hood of this invention takes the form of a knitted highly-stretchable tube, the upper portion of which is dimensioned to be stretched about the outside of a hard hat. Sliding movement (both rotational and longitudinal) between such a hood and the hat upon which it is fitted is prevented by the provision of at least one slit between the hood's upper and lower portions which receives a part of the brim, preferably the front or beak portion of that brim. Because of its stretchability, the hood may easily accommodate hats of different size. In the best mode presently known for practicing the invention, such adaptability is enhanced by providing an opening at the upper end of the tube through which a portion of the crown of the hard hat projects. Such opening is bounded by an elasticized border and, depending on the size of the hat involved, a greater or lesser extent of the crown projects upwardly through the opening of the hood.

Below the laterally-elongated brim-receiving slit of the hood is at least one face opening with a stretchable elasticized border. The lower portion of the hood is adapted to cover the face, the neck, and ears of a wearer with the face opening(s) exposing at least the wearer's eyes. In the case of a hood having only a single stretchable face opening, such opening may if desired be expanded to expose the entire front portion of the wearer's face. At the user's option, the front of the lower face mask portion may be raised to uncover the wearer's face while leaving the ears and rear neck covered, or the entire face mask portion may be lifted so that the bottom opening of the hood is reverted and extends about the crown of the hat. In the latter case, the folded portion of the face mask may nevertheless be adjusted to extend radially inwardly beneath the brim of the hat to provide a porous annular band which partially closes the annular space between the brim of the hat and a wearer's head.

While a single slit, preferably located directly above the face opening of the hood, is generally sufficient to anchor the hood against displacement with respect to the hard hat, in a second embodiment of the invention two such slits are provided to perform the anchoring function. Ideally, such slits are diametrically disposed with one being located at the rear of the hood and the other being located at the front of the hood directly above the expandable face opening.

Other objects, features, and advantages of the invention will become apparent from the specification and drawings.

DRAWINGS

DETAILED DESCRIPTION

Figure 1:
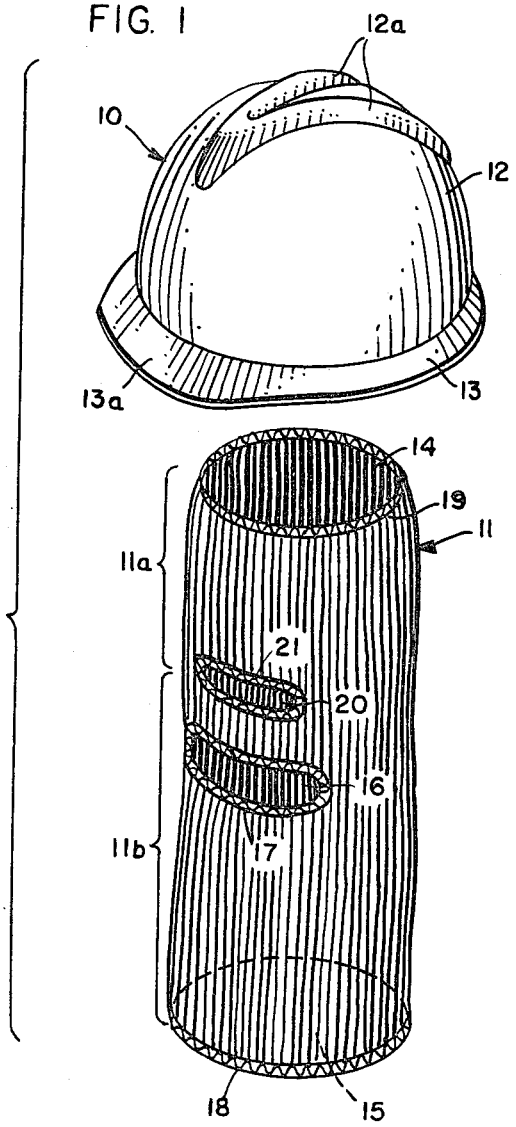
FIG. 1 is an exploded perspective view of a hood and hard hat combination embodying the present invention.

Referring to the drawings, FIG. 1 illustrates a hard hat 10 and a knitted tubular hood 11. The hat 10 is of conventional construction, having a dome-like crown portion 12 and a parametric brim portion 13. While the brim may be of substantially uniform width through its entire extent, quite typically such brim has an enlarged front or beak portion 13*a* which functions as a visor. The crown may include one or more external ribs 12*a* which reinforce the crown. Normally such a hat is integrally formed from a tough, rigid, and electrically-insulating plastic material although, where electrical insulating properties are not desired, other materials such as metals may be used.

Within the hat is a harness which is dimensioned to rest upon a wearer's head so that a space is provided between the head and the inside surface of the hard hat. Such a harness is not shown in the drawings and forms no direct part of this invention; however, reference may be had to U.S. Pat. No. 3,594,814 for the disclosure of a conventional harness and its relationship to a hard hat.

Hood 11 takes the form of a elongated knitted tube having an upper portion 11*a* and a lower portion 11*b*. The relative length of the respective portions may be varied somewhat although, where the tubular hood 11 is open at its upper end 14 as well as at its lower end 15 (as shown in the drawings), the upper portion 11*a* will generally be shorter than lower portion 11*b*. For example, in a typical construction of the type depicted in FIG. 1, the lower face mask portion may have a length ranging from 6–12 inches or more, whereas the upper portion 11*a* would have a length of about 4–9 inches. In a preferred embodiment, the respective lengths of the lower and upper sections have been found to be about 9–10 inches and 5–6 inches. As will become apparent from the following description, however, the length of the upper section is particularly subject to variation, depending largely on the presence or absence of opening 14 and, if present, the size of that opening.

The tubular sleeve or hood 11 is knitted with its ribs extending longitudinally and, therefore, the hood is highly stretchable in circumferential directions. When unstretched or untensioned, the diameter of the hood is substantially smaller than the maximum diameters of the brim portion 13 and crown portion 12 of hard hat 10. By way of example, the tubular hood may have a diameter in an unstretched state within the general range of 3–7 inches, depending largely on the tightness of the knit and the type of yarn used, whereas a typical hard hat might have maximum outside diameters of approximately 8–10 inches measured at the crown and 10–12 inches measured at the brim.

The lower portion 11*b* of the hood is intended to function as a protective face mask and, for that purpose, is provided with at least one face opening 16 in its tubular side wall. When the hood is in an unstretched state, opening 16 is circumferentially elongated within the general range of 4–7 inches. However, the size of the opening may be easily increased by simply stretching the mask to the extent desired. Stitching 17 about the border of the face opening 16 confines an elastic band so that when stretching forces are relieved the opening 16 will tend to return to its original size and shape. Similar stitching 18 about the open lower end of the hood also confines an elastic band so that the bottom opening will retain essentially the same unstretched size even after extended use of the hood.

The border of upper opening 14 is also elasticized in the manner already described, with stitching 19 confining an elastic band or cord. Such elastic cording is concealed by the stitching and is therefore not visible in the drawings; however, as well known to those skilled in the art, such cording and the stitching for holding it in place are entirely conventional.

The tubular hood may be of generally uniform diameter when in an unstretched or untensioned state, although it has been found desirable in some cases to reduce slightly the size of opening 14 by bordering that opening with an elastic band having an unstretched size somewhat smaller than the size of the knitted tube (or the unstretched size of the lower band retained by stitching 18 about bottom opening 15). Such a relationship helps to promote a snug fit between the hood and hat when the parts are assembled in the manner depicted in FIGS. 2–5. A lateral slit 20 is provided in the wall of the knitted tube 11 in the zone where the upper and lower sections 11*a* and 11*b* meet. Like opening 16, slit 20 is bordered by stitching 21 which contains an elastic band or web. As shown in FIG. 1, the slit is spaced above opening 16 and preferably has a width (when the hood is an untensioned state) less than that of the face opening. The slit is disposed directly above the face opening, is bisected by the same vertical (or axial) midplane bisecting that opening.

Figure 2:
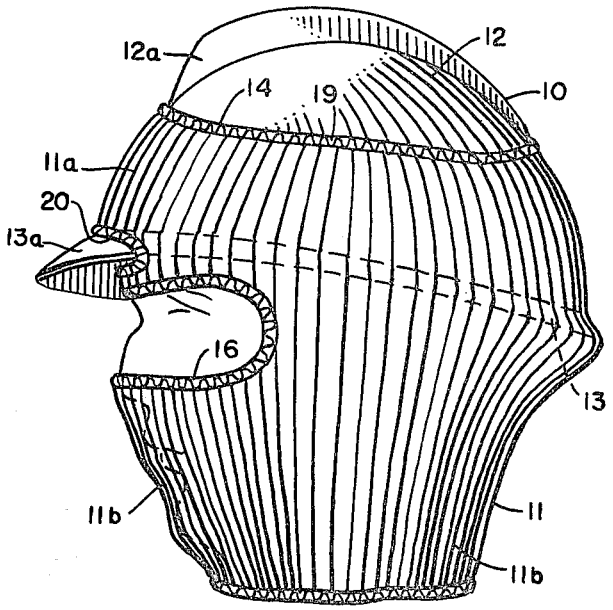
FIG. 2 is a side view showing the hood fitted upon a hard hat with the face mask portion of the hood lowered over a wearer's face, neck, and ears.

FIG. 2 illustrates the relationship of the hood 11 and hat 10 when the elements are assembled and the mask portion 11*b* is lowered to provide maximum cold weather protection for a wearer. It will be observed that the upper portion 11*a* of the hood is stretched about the hat 10 with the beak or front portion 13*a* of the brim projecting forwardly through slit 20. Since the length of the hood's upper portion 11*a* is less than the height of the hat, the upper portion of the crown 12, including reinforcing ribs 12*a*, project upwardly through the top opening 14 of the hood.

Under such conditions, the elastic about top opening 14 is in a stretched or tensioned condition and exerts an upward force upon the hood; that is, the tension of the elastic border of opening 14 exerts a force tending to reduce the size of that opening and, because the outer surface of the hard hat 10 is smooth and rounded, such tensioning at the border of the opening, as well as the tensioning of the knitted upper portion 11*a* in its entirety, causes the upper portion of the hood to draw tightly against the curved outer surface of the hat. While such tensioning might also have the effect of causing the entire hood to move upwardly over the smooth rounded surface of the hat, such movement is effectively resisted by the interlocking relation between beak 13*a* and slit 20. Resistance is also produced by the sharp reduction in the diameter of the stretchable tube immediately below the edge of brim 13.

Figure 3:
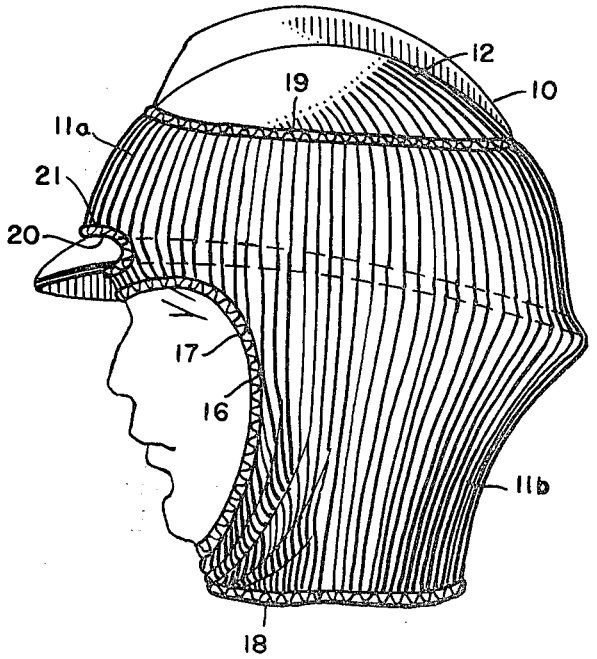
FIG. 3 is a side view similar to FIG. 2 but illustrating the face opening expanded to expose the full face of the wearer.

In FIG. 2, the hood is illustrated with face opening 16 positioned and dimensioned to expose only the region about the wearer's eyes, whereas in FIG. 3 the stretchable face opening is expanded to uncover the wearer's nose, mouth, and chin. In either case, the lower mask portion offers substantial cold weather protection for the wearer. The porosity of the knitted material renders the mask breathable; however, cold air is nevertheless restrained from flowing upwardly into the space between the wearer's head and the inner surface of the hat. As a result, the limited flow through such space tends to reduce the accumulation of moisture without at the same time admitting a rapid and objectionable dissipation of heat.

While the hard hat or helmet 10 used with hood 11 would ordinarily be of a type commonly used in industry, such as in the construction industry, such hat or helmet might also be worn as protection in other outdoor activities such as snowmobiling, iceboating, downhill skiing, and other wintertime sports activities. In any event, the hood when lowered as shown in FIGS. 2 and 3 serves the additional function of helping to hold the safety hat 10 in place upon the wearer's head. It is believed apparent that the operation of the hood in retaining the hat in place during sudden movement of the wearer might well be of critical importance under the very circumstances and at the very moment the hat is needed to protect the wearer against head injury.

Figure 4:
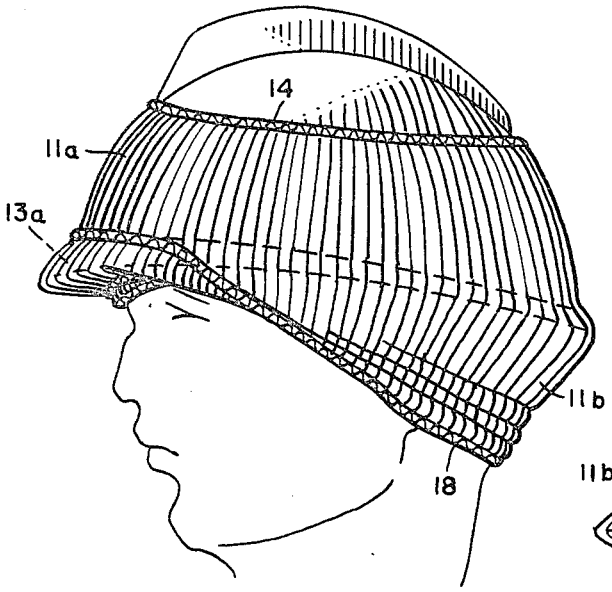
FIG. 4 is a side view similar to FIGS. 2 and 3 but showing the face mask in a partially raised position.
Figure 5:
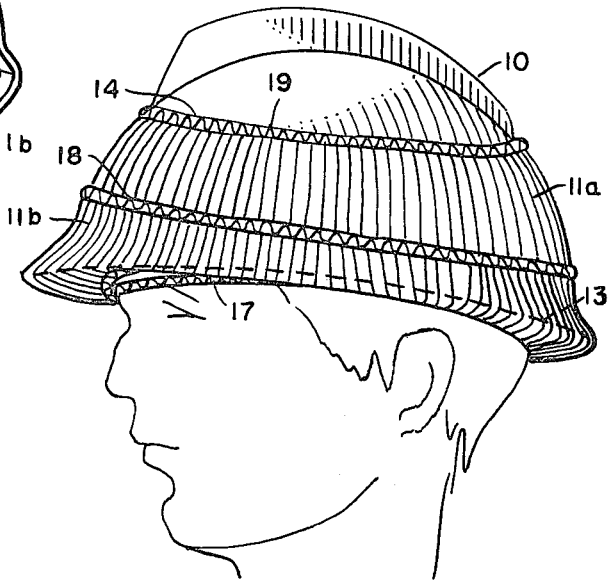
FIG. 5 is a side view similar to FIGS. 2–4 but depicting the face mask in a fully raised position.

FIGS. 4 and 5 depict other adjustments of the hood. In FIG. 4, the elasticized bottom opening 15 of the hood is enlarged and the front portion of the hood defining that opening is reverted and lifted over beak 15*a*. The beak continues to extend through slit 20 but the face opening is effectively closed and rendered non-functional. A substantial portion of the fabric of lower section 11*b* extends below the brim of the hat and covers the ears and upper neck portion of the wearer.

In FIG. 5, the rear of the lower portion 11*b* is also reversely folded up and over the brim of the hat 10. A double thickness of knitted fabric nevertheless remains beneath the brim and extends radially inwardly into contact with the wearer's head.

When use of the hood is no longer required, or when the hood is to be removed for cleaning, repair, or replacement, the user simply stretches the material about either upper opening 14 or lower opening 15 to allow the tube to be slipped over brim 13 and off of hat 10. It has been found that such removal may be accomplished by simply exerting a strong downward pulling force on the hood while at the same time holding the hat stationary. The removal operation is facilitated by gripping the fabric about slit 20 and enlarging that opening so that it clears beak 13*a*. If the hood is to be removed from the hat by sliding the hood in an upward direction then it is necessary not only to stretch the fabric so that the beak is withdrawn from opening 20 but also to expand the lower mask portion so that opening 16 passes over the beak.

Since the border of top opening 14 is elasticized, and since the knitted fabric of the upper section 11*a* is stretchable, it is believed apparent that the hood 11 is adaptable to a wide range of hard hat sizes. The portion of the crown of hat 10 exposed through top opening 14 of the hood will simply be greater in the case of a relatively large hat and smaller in the case of a relatively small hat. In any event, slit 20 receives beak 13*a* and maintains the hood with the unmarked boundary between the upper and lower sections 11*a* and 11*b* of the hood extending along the edge of brim 13. A particular advantage of the embodiment so disclosed is that it is automatically adjustable for hats of different sizes; however, where such adjustability is not desired or required, as where the hood is to be tailored for a specific style and size of hard hat, top opening 14 may be eliminated and the hood may be completely closed at its upper end.

Figure 6:
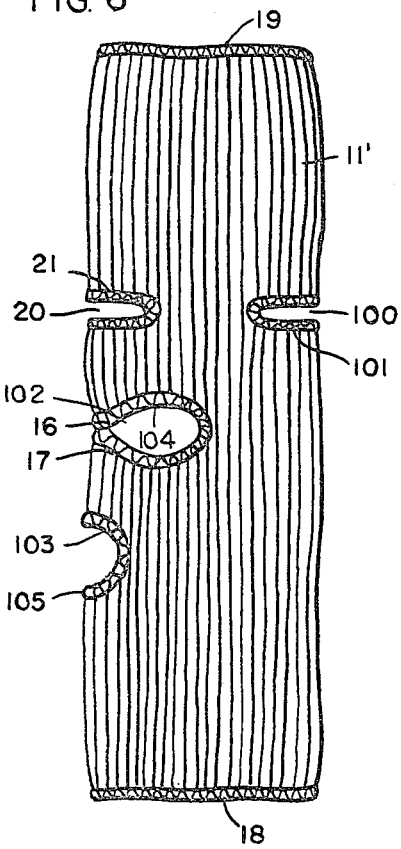
FIG. 6 is a side view of a hood constituting a second embodiment of the invention.
Figure 7:
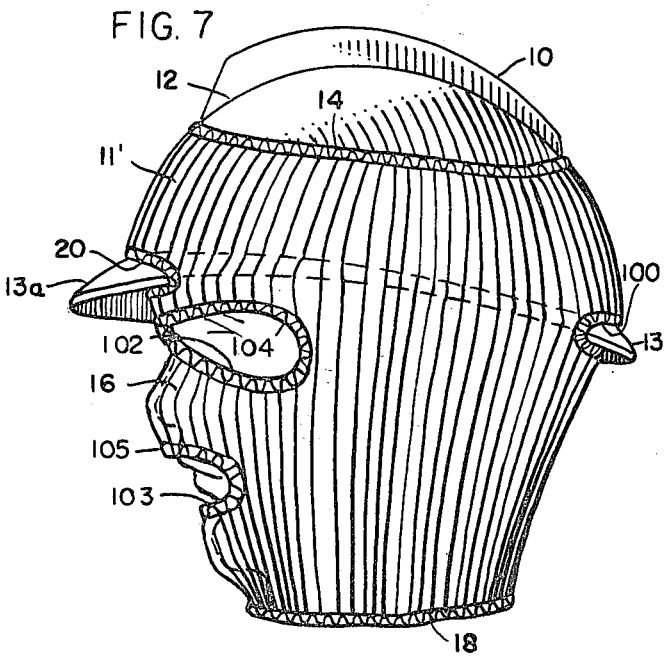
FIG. 7 is a side view illustrating the cooperative relationship between the hood of FIG. 7 and hard hat.

The embodiment depicted in FIGS. 6 and 7 is identical to the structure already described except for two differences. One lies in the addition of a second slit 100 which extends along the same transverse plane as slit 21 and which is diametrically disposed with respect to slit 21. Slit 100 is bordered by stitching 101 which confines an elastic band in the same manner as described for slit 21. As shown in FIG. 7, the rear slit 100 receives a portion of the brim 13 at the rear of hat 10, thereby assisting in securing the hat and hood against relative longitudinal, lateral, or rotational movement. While hood 11' is shown with a top opening identical to the top opening of hood 11, it is to be understood that such opening may be eliminated where, as already explained, adjustability of the hood to accommodate a wide variety of hat sizes is deemed unnecessary.

The other difference lies in the fact that hood 11' is provided with a plurality of face openings 102, 103 rather than only a single face opening 16. Specifically, hood 11' has a pair of laterally-spaced eye openings 102 (only one of which is visible in FIGS. 6 and 7), such openings being bordered by stitching 104 which preferably confines an elastic band in the same manner as already described. The two eye openings 102 are symmetrically positioned below slit 20 in the same manner that the unitary face opening 16 is so positioned in the embodiment of FIGS. 1–5.

In addition to the two eye openings 102, hood 11' may include a mouth opening 103 bordered by stitching 105 which, if desired, may also confine an elastic webbing. Since the knitted fabric of the hood is porous, the mouth opening 103 may be omitted if such a construction is preferred.

It is to be noted that the two differences which characterize the embodiment of FIGS. 6 and 7 need not be present together. Stated differently, hood 11' may have a single face opening 16 identical to that disclosed with respect to hood 11 and may differ from hood 11 only in the addition of secondary slit 100. Conversely, hood 11 of the first embodiment may be provided with a pair of eye openings 102 rather than a single face opening 16 and, depending on manufacturing or market preference, may or may not have a third face (mouth) opening 103.

While in the foregoing I have disclosed embodiments of the invention in considerable detail for purposes of illustration, it will be understood by those skilled in the art that many of these details may be varied without departing from the spirit and scope of the invention.

I claim:

1. A protective hood for use with a safety hat having rigid integral crown and brim portions, said hood comprising a tube of stretchable knitted fabric having upper and lower portions and having a maximum diameter in an unstretched state substantially smaller than the brim of a safety hat to be worn therewith, said tube being open at its lower end and having at least one face opening located in said lower portion, said tube also having at least one brim-receiving slit between said upper and lower portions for receiving a portion of the brim of a safety hat to anchor said tube against longitudinal and lateral sliding movement relative to a safety hat over which said upper portion of said tube is fitted, said slit and face opening being spaced apart to define a lateral band of fabric therebetween for protecting a wearer's forehead and for restraining upward movement of said hood upon a safety hat.

2. The hood of claim 1 in which said tube is also opened at the upper end thereof.

3. The hood of claim 2 in which said tube is provided with an elasticized border about said open upper end.

4. The hood of claim 1 in which said tube is closed at the upper end thereof.

5. The hood of claim 1 in which a single face opening is provided with an elasticized border and is laterally elongated when said tube is in an unstretched state.

6. The hood of claim 1 in which said slit is laterally elongated and is spaced directly above said face opening.

7. The hood of claim 6 in which a second slit is provided by said tube, said second slit being disposed between said upper and lower portions and being diametrically oriented with reference to said first mentioned slit.

8. The hood of claim 7 in which elasticized borders are provided about said first and second slits.

9. The hood of claims 1 or 6 in which an elasticized border is provided around said slit.

10. The hood of claim 1 in which the maximum diameter of said upper portion of said tube when the same is unstretched is substantially smaller than the crown portion of a safety hat upon which said tube is adapted to be fitted.

11. The hood of claim 1 in which a pair of said face openings are provided for alignment with a wearer's eyes when said hood is worn in lowered condition.

12. A safety hat having rigid integral crown and brim portions and a tubular hood of stretchable knitted fabric having an upper hat-receiving portion being open at its lower end and having at least one face opening located intermediate at the upper and lower limits thereof, said tube having a maximum diameter in an unstretched state substantially smaller than the brim of said safety hat and having the upper portion thereof stretched about and tightly receiving said brim and crown portions of said hat, said tube also having a laterally-elongated slit interposed between said upper and lower portions and receiving a portion of said brim to anchor said tube against unintentional sliding of said tube relative to said hat, said slit and face opening being spaced apart to define a lateral band of fabric therebetween for protecting a wearer's forehead and for restraining upward movement of said tube upon said hat.

13. The combination of claim 12 in which said tube is open at the upper end thereof.

14. The combination of claim 13 in which said tube includes a stretchable elastic border about said open end.

15. The combination of claims 13 or 14 in which said crown projects upwardly through said open upper end of said tube.

16. The combination of claim 12 in which said tube is closed at the upper end thereof.

17. The combination of claim 12 in which said face opening is laterally elongated when said face mask portion is in an unstretched state.

18. The combination of claim 17 in which said slit is disposed directly above and spaced from said face opening.

19. The combination of claim 18 in which a second slit is provided by said tube, said second slit being diametrically disposed with reference to said first-mentioned slit.

20. The combination of claim 19 in which elastic borders are provided about said first and second slits.

21. The combination of claims 12 or 18 in which an elastic border is provided around said slit.

22. The combination of claim 12 in which said crown portion of said hat is dome-shaped and is provided with a smooth hard outer surface, said upper portion of said tube when in an unstretched state having a diameter substantially smaller than the maximum diameter of said crown portion, whereby, said upper portion of said tube is stretched tightly about the crown portion of said hat received therein.

23. The combination of claim 12 in which a pair of said face openings are provided for alignment with a wearer's eyes when said mask portion is worn in lowered condition.

24. The combination of claim 23 in which said mask portion also includes a mouth opening.

* * * * *